US010174521B2

(12) United States Patent
Lin

(10) Patent No.: US 10,174,521 B2
(45) Date of Patent: Jan. 8, 2019

(54) DISC TUMBLER LOCK ASSEMBLY

(71) Applicant: XIAMEN MAKE SECURITY TECHNOLOGY CO., LTD., Xiamen (CN)

(72) Inventor: Shaolian Lin, Xiamen (CN)

(73) Assignee: XIAMEN MAKE SECURITY TECHNOLOGY CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/613,283

(22) Filed: Jun. 5, 2017

(65) Prior Publication Data

US 2018/0171662 A1 Jun. 21, 2018

(30) Foreign Application Priority Data

Dec. 15, 2016 (CN) ..... 2016 2 1377991

(51) Int. Cl.

| | |
|---|---|
| ***E05B 29/00*** | (2006.01) |
| ***E05B 15/14*** | (2006.01) |
| *E05B 9/04* | (2006.01) |
| *E05B 63/02* | (2006.01) |
| *E05B 15/16* | (2006.01) |

(52) U.S. Cl.

CPC ..... *E05B 29/006* (2013.01); *E05B 15/14* (2013.01); *E05B 29/0066* (2013.01); *E05B 9/04* (2013.01); *E05B 15/1614* (2013.01); *E05B 63/02* (2013.01)

(58) Field of Classification Search

CPC ..... E05B 9/04; E05B 21/066; E05B 29/0013; E05B 29/006; E05B 29/0066

USPC ..... 70/366

See application file for complete search history.

(56) References Cited

U.S. PATENT DOCUMENTS

| | | | | | |
|---|---|---|---|---|---|
| 3,821,886 | A * | 7/1974 | Ladewig | E05B 9/04 | 70/366 |
| 3,942,346 | A * | 3/1976 | Luotolainen | E05B 21/066 | 70/366 |
| 3,972,210 | A * | 8/1976 | Toivonen | E05B 29/0013 | 70/366 |
| 4,008,588 | A * | 2/1977 | Miller | E05B 21/066 | 70/366 |
| 4,062,211 | A * | 12/1977 | Miller | E05B 21/066 | 70/366 |
| 4,083,212 | A * | 4/1978 | Proefrock | E05B 17/0062 | 70/366 |
| 4,109,495 | A * | 8/1978 | Roberts | E05B 21/066 | 70/365 |

(Continued)

*Primary Examiner* — Suzanne L Barrett
(74) *Attorney, Agent, or Firm* — Leong C. Lei

(57) ABSTRACT

A disc tumbler lock assembly includes a lock cylinder inserted in a lock cylinder chamber of a lock housing, the lock cylinder being formed with a disc cavity and a lug groove; inner locking discs each having a first key hole with a first locking tooth therein, a side of each inner locking disc being formed with a first latch notch and a first lug located in the lug groove; outer locking discs each having an inner locking disc room and a second key hole with a second locking tooth therein, a side of each outer locking disc being formed with a second latch notch and a second lug located in the lug groove; the inner and outer locking discs being arranged in pairs, a corresponding one of the inner locking discs being disposed in the inner locking disc room of a corresponding one of the outer locking discs.

9 Claims, 4 Drawing Sheets

(56) References Cited

U.S. PATENT DOCUMENTS 4,351,172 A * 9/1982 Martikainen ..... E05B 21/066 70/366
4,370,875 A * 2/1983 Piiroinen ..... E05B 21/066 70/422
4,407,147 A * 10/1983 Larson ..... E05B 21/066 70/365
4,512,166 A * 4/1985 Dunphy ..... E05B 21/06 70/366
4,578,969 A * 4/1986 Larson ..... E05B 21/066 70/366
4,667,493 A * 5/1987 Takahashi ..... E05B 21/066 70/366
4,686,843 A * 8/1987 Martikainen ..... E05B 21/066 70/366
4,742,703 A * 5/1988 DeWalch ..... E05B 21/066 70/366
5,205,143 A * 4/1993 Hakkarainen ..... E05B 21/066 70/366
5,388,438 A * 2/1995 Paavo ..... E05B 21/066 70/366
5,934,121 A * 8/1999 Chen ..... E05B 21/066 70/365
6,155,089 A * 12/2000 Hurskainen ..... E05B 47/0623 70/187
6,185,966 B1 * 2/2001 Chen ..... E05B 17/04 70/366
6,553,801 B2 * 4/2003 Chen ..... E05B 21/066 70/365
6,591,645 B1 * 7/2003 Wittwer ..... E05B 21/066 70/366
6,758,074 B1 * 7/2004 Prunbauer ..... E05B 19/0017 70/366
6,799,447 B2 * 10/2004 Mielonen ..... E05B 21/066 70/366
7,694,542 B2 * 4/2010 Loughlin ..... E05B 19/00 70/329
7,703,311 B2 * 4/2010 Agbay ..... E05B 21/066 70/340
8,689,595 B2 * 4/2014 Martikainen ..... E05B 19/0017 70/366
8,925,360 B2 * 1/2015 Agbay ..... E05B 21/066 70/337
2016/0186462 A1 * 6/2016 Wehr ..... E05B 19/00 70/353

* cited by examiner

DISC TUMBLER LOCK ASSEMBLY

BACKGROUND OF THE INVENTION

1. Field of the Invention

The present invention relates to a cylinder lock assembly, and more particularly, to a disc tumbler lock assembly.

2. Description of the Prior Art

The working principle of a disc tumbler lock uses the bittings at an angle of a key to align the locking discs at an angle of a lock cylinder to undo the lock.

The lock cylinder of a conventional disc tumbler lock is a single-layer code, and the locking discs of the lock cylinder need to cooperate with springs. The single-layer code structure is simple and the security is not high, so it is easy to be unlocked. Accordingly, the present invention intends to provide a dual faucet structure for improving the shortcomings mentioned above.

SUMMARY OF THE INVENTION

The primary object of the present invention is to provide a disc tumbler lock assembly which has a simple structure and high performance of security.

In order to achieve the aforesaid object, the disc tumbler lock assembly of the present invention comprises a lock housing, a lock cylinder, spacers, inner locking discs, outer locking discs, a latch, and a key. The lock housing has a lock cylinder chamber, a latch recess, and a main key hole. The lock cylinder is inserted in the lock cylinder chamber in a rotatable manner. The lock cylinder is formed with a disc cavity, a lug groove, and a latch groove. Each of the inner locking discs is formed with a key hole. The key hole is provided with a raised locking tooth. A side of each of the inner locking discs is formed with a latch notch and a first lug located in the lug groove. Each of the outer locking discs is formed with an inner locking disc room and a key hole. The key hole of the outer locking discs is provided with a raised locking tooth. A side of each of the outer locking discs is formed with a latch notch and a lug located in the lug groove. The inner locking discs and the outer locking discs are arranged in pairs. A corresponding one of the inner locking discs is disposed in the inner locking disc room of a corresponding one of the outer locking discs. A corresponding one of the spacers is placed between every adjacent two pairs of the inner and outer locking discs. Each of the spacers is formed with a key hole. The inner locking discs and the outer locking discs arranged in pairs are mounted in the disc cavity. The latch is inserted in the latch groove of the lock cylinder. A latch return spring is provided between the latch and the lock cylinder. The key has an inert lever insertable in the main key hole, the key hole of the inner locking discs, the key hole of the outer locking discs, and the key hole of the spacers. The insert lever is formed with a semi-circular surface. The semi-circular surface is formed with inner bittings to mate with the locking teeth of the inner locking discs and the locking teeth of the outer locking discs for driving the inner locking discs and the outer locking discs to rotate about a central axis of the disc cavity of the lock cylinder, enabling the latch notches of the inner locking discs and the latch notches of the outer locking discs to align the latch groove.

Preferably, the insert lever is formed with a semi-circular surface. The semi-circular surface is formed with snakelike inner bittings arranged in two rows.

Preferably, the sides of the inner locking discs and the outer locking discs are formed with corresponding anti-pick notches, respectively.

Preferably, the lock cylinder is provided with an anti-drill disc in the disc cavity close to the main key hole of the lock housing. The anti-drill disc is formed with a key hole. Preferably, a side of the anti-drill disc is formed with a lug located in the lug groove and a positioning block located in the latch groove.

Preferably, a pair of spring seats is provided at front and rear ends of the disc cavity of the lock cylinder. Each of the spring seats is formed with a key hole. A side of each of the spring seats is formed with a spring groove. The latch return spring is placed in the spring groove and pressed against the latch. Preferably, the side of each of the spring seats is formed with a lug located in the lug groove.

Preferably, the lock housing is formed with a snap ring groove therein. The lock cylinder is formed with a step thereon. The lock cylinder is inserted in the lock cylinder chamber. A snap ring is provided and engaged with the snap ring groove and the step.

Preferably, a side of each of the spacers is formed with a lug located in the lug groove and a latch notch.

Thereby, the inner locking discs and the outer locking discs of the present invention do not need return springs. The locking discs can be aligned and returned just by the insertion of a key. The structure is simpler. The locking teeth of the inner locking discs and the locking teeth of the outer locking discs are mated with the inner bittings of the key by rotating. The inner locking discs and the outer locking discs are arranged in pairs. In case the number of the locking disc sets is n, the inner and outer locking discs have in variations in angle, and n sets of the locking discs have 2n locking discs, the number of the variations of the key bittings is m2n. This lock can improve the security greatly.

DETAILED DESCRIPTION OF THE PREFERRED EMBODIMENTS

Embodiments of the present invention will now be described, by way of example only, with reference to the accompanying drawings.

Figure 1:
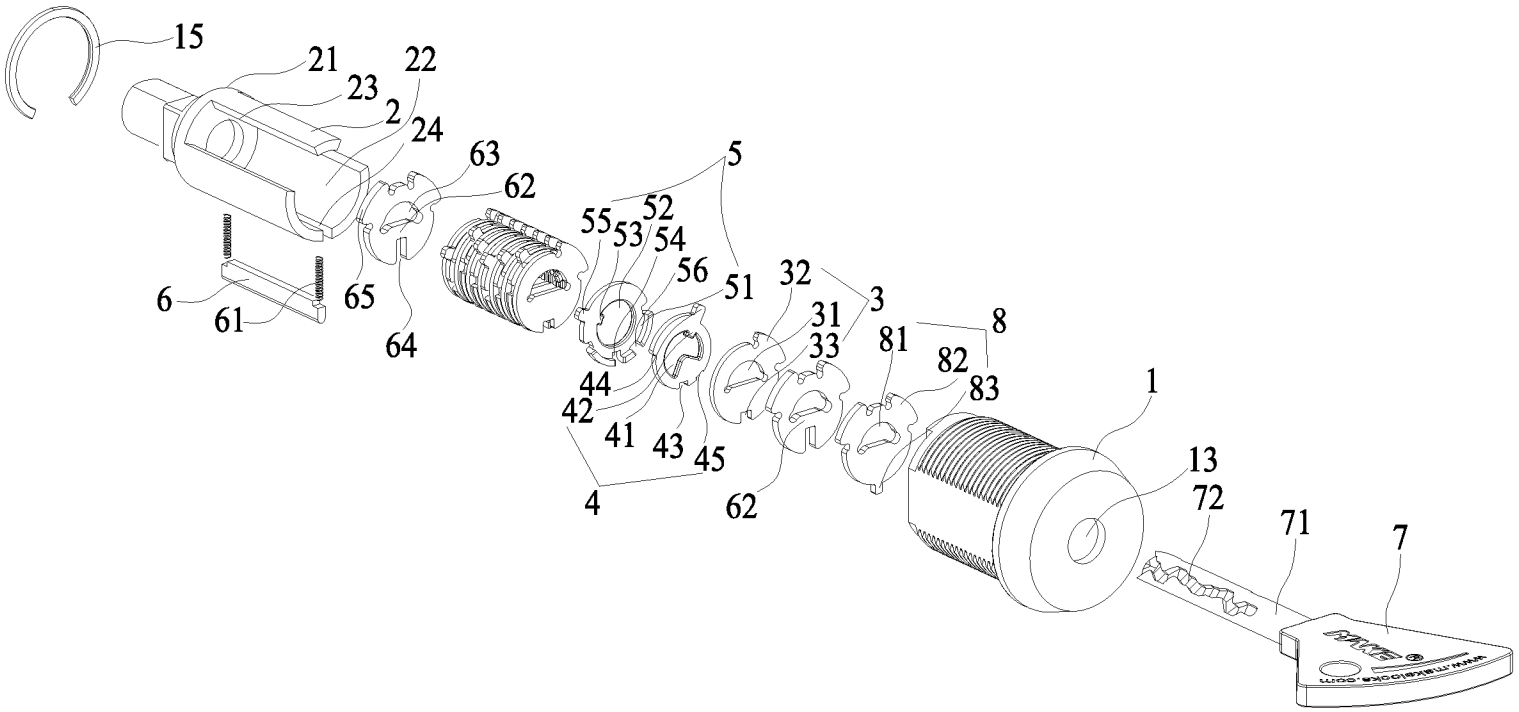
FIG. 1 is an exploded view of the present invention.
Figure 2:
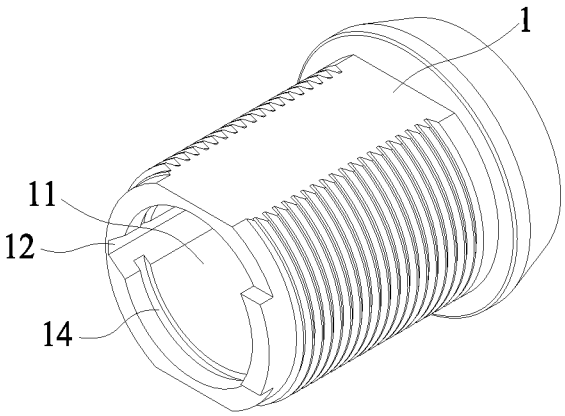
FIG. 2 is a rear view of the lock housing of the present invention.
Figure 3:
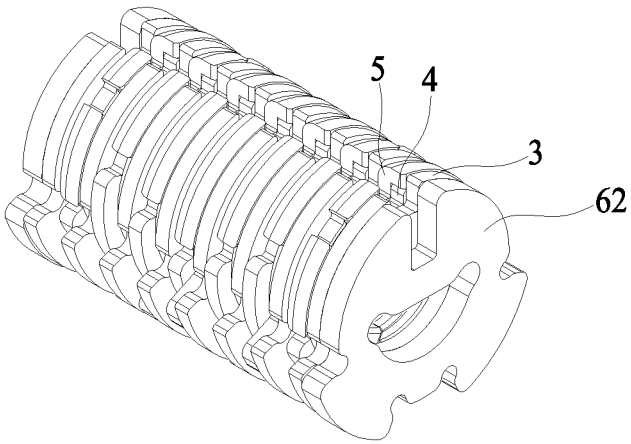
FIG. 3 is a perspective view of the spring seats, the spacers, the inner locking discs, and the outer locking discs of the present invention in an unlocked state.
Figure 4:
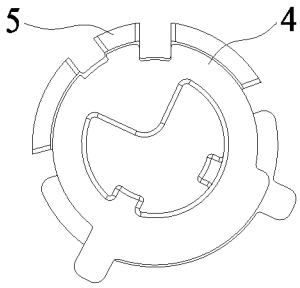
FIG. 4 is a side view of the inner locking discs and the outer locking discs of the present invention in an unlocked state.
Figure 5:
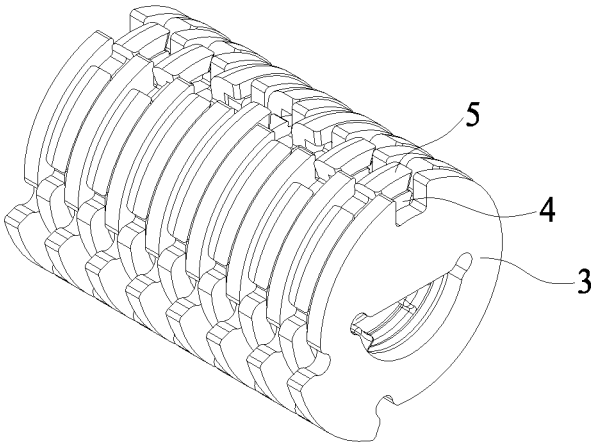
FIG. 5 is a perspective view of the spring seats, the spacers, the inner locking discs, and the outer locking discs of the present invention in a locked state.
Figure 6:
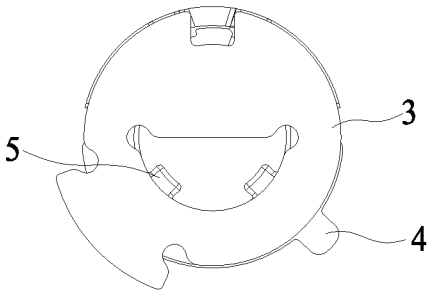
FIG. 6 is a side view of the spacers, the inner locking discs, and the outer locking discs of the present invention in a locked state.
Figure 7:
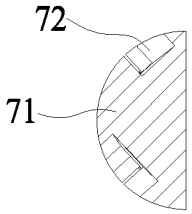
FIG. 7 is a sectional view of the insert lever of the key of the present invention.
Figure 8:
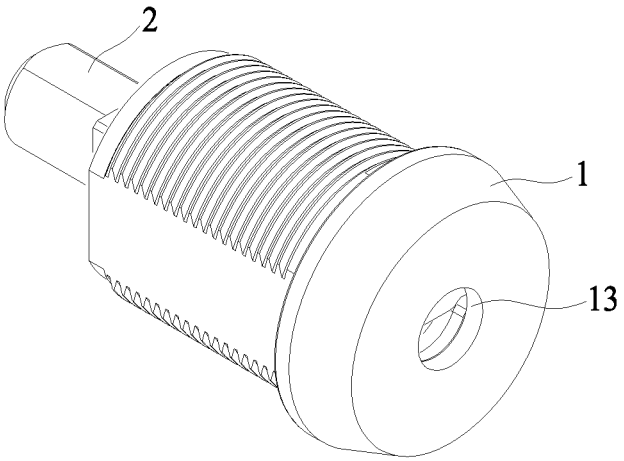
FIG. 8 is a perspective view of the present invention.
Figure 9:
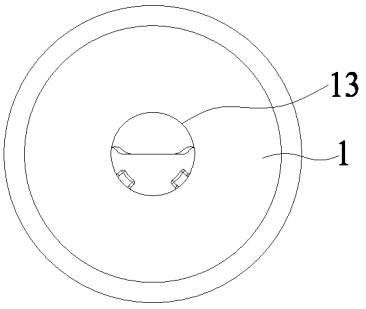
FIG. 9 is a front view of the present invention.

As shown in FIG. 1 to FIG. 9, the present invention discloses a disc tumbler lock assembly. The disc tumbler assembly comprises a lock housing 1, a lock cylinder 2, spacers 3, inner locking discs 4, outer locking discs 5, a latch 6, and a key 7.

The lock housing 1 has a lock cylinder chamber 11, a latch recess 12, and a main key hole 13.

The lock cylinder 2 is inserted in the lock cylinder chamber 11 in a rotatable manner. For ease of assembly and disassembly, the lock housing 1 is formed with a snap ring groove 14 therein. The lock cylinder 2 is formed with a step 21 thereon. The lock cylinder 2 is inserted in the lock cylinder chamber 11. A snap ring 15 is provided and engaged with the snap ring groove 14 and the step 21. The lock cylinder 2 is formed with a disc cavity 22, a lug groove 23, and a latch groove 24.

Each inner locking disc 4 is formed with a first key hole 41. The first key hole 41 is provided with a raised first locking tooth 42. A side of each inner locking disc 4 is formed with a first latch notch 43 and a first lug 44 located in the lug groove 23.

Each outer locking disc 5 is formed with an inner locking disc room 51 and a second key hole 52. The second key hole 52 is provided with a raised second locking tooth 53. A side of each outer locking disc 5 is formed with a second latch notch 54 and a second lug 55 located in the lug groove 23.

The inner locking discs 4 and the outer locking discs 5 are arranged in pairs. A corresponding one of the inner locking discs 4 is disposed in the inner locking disc room 51 of a corresponding one of the outer locking discs 5. A corresponding one of the spacers 3 is placed between every adjacent two pairs of the inner and outer locking discs 4, 5. Each spacer 3 is formed with a third key hole 31. The inner locking discs 4 and the outer locking discs 5 arranged in pairs are mounted in the disc cavity 22. In order to facilitate the mounting and positioning, a side of the spacer 3 is formed with a fifth lug 32 located in the lug groove 23 and a third latch notch 33.

The latch 6 is inserted in the latch groove 24 of the lock cylinder 2. A latch return spring 61 is provided between the latch 6 and the lock cylinder 2. In order to facilitate the installation of the latch return spring 61, a pair of spring seats 62 is provided at front end rear ends of the disc cavity 22 of the lock cylinder 2. A side of each spring seat 62 is formed with a fourth lug 65 located in the lug groove 23 to retain the spring seat 62. Each spring seat 62 is formed with a fifth key hole 63. The side of each spring seat 62 is formed with a spring groove 64. The latch return spring 62 is placed in the spring groove 64 and pressed against the latch 6.

The key 7 has an insert lever 71 which can be inserted in the main key hole 13, the first key hole 41, the second key hole 52, and the third key hole 31. The insert lever 71 is formed with a circular surface. The circular surface is formed with inner bittings 72 arranged in upper and lower rows. The inner bittings 72 are mated with the first locking teeth 42 of the inner locking discs 4 and the second locking teeth 53 of the outer locking discs 5. In another embodiment, the insert lever 71 is formed with a semi-circular surface. The semi-circular surface is formed with snakelike inner bittings 72 arranged in two rows. It is not easy to duplicate the key.

When the disc tumbler lock assembly of the present invention is in a locked state or the key is incorrect, the first latch notches 43 of the inner locking discs 4 and the second latch notches 54 of the outer locking discs 5 are not aligned with the latch groove 24, and the latch 6 cannot enter the first latch notches 43 and the second latch notches 54 to be engaged in the latch recess 12 of the lock housing 1 so that the lock cylinder 2 cannot be rotated. When the correct key 7 is inserted, the inner bittings 72 drive the inner locking discs 4 and the outer locking discs 5 to rotate about the central axis of the disc cavity 22 of the lock cylinder 2, such that the first latch notches 43 of the inner locking discs 4 and the second latch notches 54 of the outer locking discs 5 are aligned with the latch groove 24. After that, the key 7 is further turned to rotate the lock cylinder 2 to push the latch 6 to compress the latch return spring 61 to disengage from the latch recess 12 and to enter the first latch notches 43 and the second latch notches 54 to disengage from the latch recess 12 of the lock housing 1, thereby allowing the key 7 to drive the lock cylinder 2 to rotate and unlock.

In order to further improve the performance of security, the sides of the inner locking discs 4 and the outer locking discs 5 of the present invention are formed with corresponding anti-pick notches 45, 56, respectively. The lock cylinder 2 is provided with an anti-drill disc 8 in the disc cavity 22 close to the main key hole 13 of the lock housing 1. The anti-drill disc 8 is formed with a fourth key hole 81 for insertion of the insert lever 71 of the key 7. A side of the anti-drill disc 8 is formed with a third lug 82 located in the lug groove 23 and a positioning block 83 located in the latch groove 24. The anti-drill disc 8 is configured to prevent drilling and cutting.

The inner locking discs 4 and the outer locking discs 5 of the present invention constitute a double-layer structure. The inner locking discs 4 and the outer locking discs 5 do not need the springs and uses the inner bittings 72 arranged in upper and lower rows to achieve an angular code which is extremely difficult to be unlocked and has high security. The inner locking discs 4 and the outer locking discs 5 may be made of stainless steel with high strength, wear resistance and corrosion resistance. The number of the locking disc sets of the present invention determines the number of the variations of key bittings. For example, the number of the locking disc sets is seven. In case the inner locking disc 4 and the outer locking discs 5 have four variations in angle and seven sets of locking discs have fourteen locking discs, the number of the variations of the key bittings is 414, namely, 260 million. In case the inner locking disc 4 and the outer locking discs 5 have five variations in angle, the number of the variations of the key bittings is 514, namely, 60 billion. This lock can improve the security greatly.

Compared to the conventional plate tumbler lock assembly, the present invention adopts an angular code and the code doesn't need springs. The inner locking discs 4 and the outer locking discs 5 may be formed by stamping, so the cost is low. The conventional plate tumbler lock assembly adopts a linear code and the code needs springs. The locking plates of the conventional plate tumbler lock assembly are formed by powder injection molding, so the cost is high.

Compared to the conventional disc tumbler lock assembly, the present invention adopts a double-layer code. The unlocking is carried out without idling. The circular surface of the key 7 is formed with the inner bittings 72 arranged in upper and lower rows to provide high security. The conventional disc tumbler lock assembly adopts a single-layer code. The key is idle at a certain angle to undo the lock. The key 7 is laterally drilled to form the bittings, so the security is poor.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A disc tumbler lock assembly, comprising a lock housing, a lock cylinder, spacers, inner locking discs, outer locking discs, a latch, and a key;

the lock housing having a lock cylinder chamber, a latch recess, and a main key hole;

the lock cylinder being inserted in the lock cylinder chamber in a rotatable manner, the lock cylinder being formed with a disc cavity, a lug groove, and a latch groove;

each of the inner locking discs being formed with a key hole, the key hole being provided with a raised locking tooth, a side of each of the inner locking discs being formed with a latch notch and a lug located in the lug groove;

each of the outer locking discs being formed with an inner locking disc room and a key hole, the key hole of the outer locking discs being provided with a raised locking tooth, a side of each of the outer locking discs being formed with a latch notch and a lug located in the lug groove;

the inner locking discs and the outer locking discs being arranged in pairs, a corresponding one of the inner locking discs being disposed in the inner locking disc room of a corresponding one of the outer locking discs, a corresponding one of the spacers being placed between every adjacent two pairs of the inner and outer locking discs, each of the spacers being formed with a key hole, the inner locking discs and the outer locking discs arranged in pairs being mounted in the disc cavity;

the latch being inserted in the latch groove of the lock cylinder, a latch return spring being provided between the latch and the lock cylinder;

the key having an insert lever insertable in the main key hole of the lock housing, the key hole of the inner locking discs, the key hole of the outer locking discs, and the key hole of the spacers, the insert lever being formed with a semi-circular surface, the semi-circular surface being formed with inner bittings to mate with the locking teeth of the inner locking discs and the locking teeth of the outer locking discs for driving the inner locking discs and the outer locking discs to rotate about a central axis of the disc cavity of the lock cylinder, enabling the latch notches of the inner locking discs and the latch notches of the outer locking discs to align the latch groove.

2. The disc tumbler lock assembly as claimed in claim 1, wherein the semi-circular surface of the insert lever is formed with snakelike inner bittings.

3. The disc tumbler lock assembly as claimed in claim 1, wherein the sides of the inner locking discs and the outer locking discs are formed with corresponding anti-pick notches, respectively.

4. The disc tumbler lock assembly as claimed in claim 1, wherein the lock cylinder is provided with an anti-drill disc in the disc cavity close to the main key hole of the lock housing, and the anti-drill disc is formed with a key hole.

5. The disc tumbler lock assembly as claimed in claim 4, wherein a side of the anti-drill disc is formed with a lug located in the lug groove and a positioning block located in the latch groove.

6. The disc tumbler lock assembly as claimed in claim 1, wherein a pair of spring seats is provided at front and rear ends of the disc cavity of the lock cylinder, each of the spring seats is formed with a key hole, a side of each of the spring seats is formed with a spring groove, and the latch return spring is placed in the spring groove and pressed against the latch.

7. The disc tumbler lock assembly as claimed in claim 6, wherein the side of each of the spring seats is formed with a lug located in the lug groove.

8. The disc tumbler lock assembly as claimed in claim 1, wherein the lock housing is formed with a snap ring groove therein, the lock cylinder is formed with a step thereon, the lock cylinder is inserted in the lock cylinder chamber, and a snap ring is provided and engaged with the snap ring groove and the step.

9. The disc tumbler lock assembly as claimed in claim 1, wherein a side of each of the spacers is formed with a lug located in the lug groove and a latch notch.

* * * * *